United States Patent [19]

Levin

[11] 4,247,029

[45] Jan. 27, 1981

[54] STRINGED MUSICAL INSTRUMENT AND FRAME THEREFOR

[76] Inventor: Jeffrey S. Levin, 25-36 Jackson Ave., Long Island City, N.Y. 11101

[21] Appl. No.: 71,009

[22] Filed: Aug. 30, 1979

Related U.S. Application Data

[63] Continuation-in-part of Ser. No. 941,390, Sep. 11, 1978, abandoned.

[51] Int. Cl.[3] ..... G10D 3/00; G10G 5/00

[52] U.S. Cl. ..... 224/271; D17/19; 84/327; 224/910

[58] Field of Search ..... 84/173, 267, 290, 291, 84/293, 327, 453; 224/153, 156, 910, 271; D17/14, 19

[56] References Cited

U.S. PATENT DOCUMENTS

| | | | |
|---|---|---|---|
| 508,543 | 11/1893 | Hay | 84/291 |
| 1,648,713 | 11/1927 | Andersh | 84/291 |
| 2,510,799 | 6/1950 | Carley | 84/327 |
| 3,881,644 | 5/1975 | Demaline | 224/153 |
| 3,894,464 | 7/1975 | Brooks | 84/327 |
| 4,192,213 | 3/1980 | Steinberger | 84/327 |

*Primary Examiner*—Lawrence R. Franklin
*Attorney, Agent, or Firm*—Bauer & Amer

[57] ABSTRACT

A stringed musical instrument having a body and a neck extending outwardly therefrom and a support frame having at least one lateral or side arm secured to the body of the instrument with the arm being selectively adjustable and extensible such that when a shoulder strap is attached between the instrument and the selectively adjustable arm, the support of the strap may be selectively varied about the neck of the player and the balance of the instrument may be changed in correspondence with the change in the center of gravity effected by the variation in the extension of the arm.

10 Claims, 6 Drawing Figures

1
2
3
3A
4
5
6
7
8
9
10
15
20
22

STRINGED MUSICAL INSTRUMENT AND FRAME THEREFOR

RELATED APPLICATIONS

This is a Continuation-In-Part application of Ser. No. 941,390, filed on Sept. 11, 1978, in the name of Jeffrey S. Levin, now abandoned.

BACKGROUND OF THE INVENTION

The invention relates generally to a musical instrument and, more particulary, to a stringed musical instrument such as, for example, an acoustic or an electronic guitar, which includes means to permit adjustable balancing and support of the instrument.

Stringed musical instruments such as acoustic and electronic guitars are traditionally played in a substantially horizontal position. In order to maintain the instrument in such a position for extended periods of time, shoulder support straps are often used to assist the musician. Such straps are typically attached at fixed points on opposite sides of the body portion of the instrument or at fixed points on the body and neck of the instrument. The musician then wraps the shoulder strap over his or her shoulders placing the center of balance of the instrument at the musician's neck. This is illustrated in U.S. Pat. No. 3,894,464 which issued to B. Brooks on July 15, 1975.

A shoulder strap attached at opposite ends of the body of the instrument will maintain a guitar in a horizontal position only if the instrument is evenly balanced. Such, however, is oftentimes not the case. Modern electronic guitars tend to be heavier in the neck and peghead than in the body causing the instrument balancing in that direction. As such, the musician is forced to expend considerable effort in maintaining the instrument in this horizontal position, particularly when playing it for any prolonged period of time.

This balancing problem can be eliminated by affixation of the strap to the body of the instrument and to the neck or peghead of the guitar. However, such placement does present a number of other disadvantages. Attachment of the strap to the neck or peghead of the guitar interferes with the musician's fingering of the strings on the neck. Additionally, such attachment oftentimes interferes with the use of such devices as capos for changing the key of certain music. When the strap is attached to the peghead of the instrument, there is also a tendency for the instrument to slide down around the musician's neck since the strap becomes stretched almost horizontally.

Against the foregoing background, it is a primary object of the present invention to provide a stringed musical instrument which includes adjustable means to balance the instrument while it is being played by a musician.

It is another object of the present invention to provide a stringed musical instrument which includes an adjustable support frame to which a shoulder strap is attached for adjustable balancing of the instrument.

It is still another object of the present invention to provide a stringed musical instrument which can be easily carried without a case.

It is yet another object of the present invention to provide a stringed musical instrument which can be supported in a stable position on the floor or leaning against the wall during periods of non-use while the body of the instrument is free of damaging contact therewith.

SUMMARY OF THE INVENTION

To the accomplishment of the foregoing objects and advantages, the present invention, in brief summary, comprises a stringed musical instrument including a body; a neck extending outwardly from the body; a support frame having at least one arm including at least one extensible end; and a shoulder support strap attached at one end to the body of the instrument and at its opposite end to the extensible arm. By varying the adjustment of the extensible arm the strap attached to it can be moved relative to the neck of the player about which it is supported so as to vary the point of support of the strap relative to the neck of the player without interfering with the "play" of the instrument. The selective and varied adjustment of the extensible arm enables the player to "fine tune" the balance of the instrument during play without tiring the player.

BRIEF DESCRIPTION OF THE DRAWINGS

The foregoing and still other objects and advantages of the present invention will be more apparent from the following detailed explanation of the preferred embodiments of the present invention with the accompanying drawings wherein.

DESCRIPTION OF THE PREFERRED EMBODIMENTS

Figures 1, 2, 3, 4:
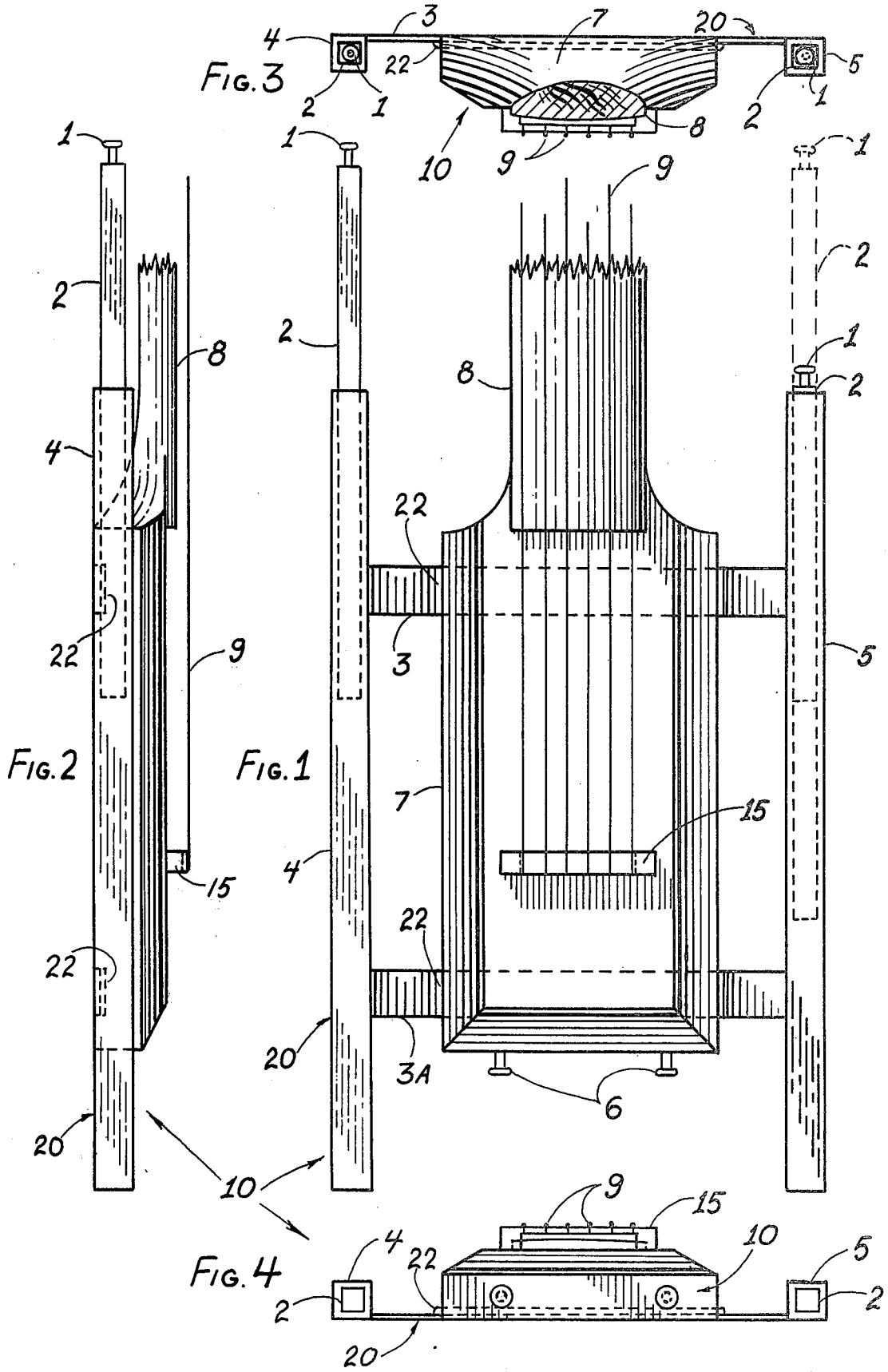
FIG. 1 is a top plan view of the body and a portion of the neck of the stringed musical instrument of the present invention including a frame support.
FIG. 2 is a side elevation view of the instrument of FIG. 1.
FIG. 3 is a front elevation view of the instrument of FIG. 1.
FIG. 4 is a rear elevation view of the instrument of FIG. 1.

Referring now to the drawings and, in particular, to FIGS. 1–4 thereof, there is shown a completed musical instrument in the form of an electronic guitar referred to generally by reference numeral 10. The illustration of an electronic guitar is for ease of explanation only and is not to be deemed a limitation upon the scope of the invention that is capable of being employed with any stringed instrument. The guitar 10 includes a body 7 and a neck 8 extending outwardly from the body 7. A plurality of playing strings 9 extend from string support bridge 15 on the body 7 to the peghead 11 (shown in FIG. 5) at the end of the neck 8 where the tension of the strings 9 may be adjusted by conventional tuning devices. It is, of course, understood that guitar 10 may also be an acoustic or classic guitar or any other type of stringed musical instrument and that the illustration of an electronic guitar has been shown for ease of explanation only without limiting the scope of the invention.

A support frame generally identified as 20 includes at least one but preferably two relatively spaced substantially parallel side or lateral arms 4 and 5 of equal length. Illustrated in FIGS. 1–4, the support frame 20 includes the two substantially parallel lateral arms 4 and 5 interconnected in their spaced relationship by upper and lower cross brackets 3 and 3A that are conveniently utilized to secure the frame 20 and the body 7 together as the completed musical instrument 10 in any convenient attachment means such as an adhesive 22 or other suitable fastening devices. When the body 7 and frame 20 are connected with each other, the length of the arms 4 and 5 are such as to be substantially greater in length than the body 7 so they will project beyond the rear of the body. In this manner when the instrument is stood on end above the floor or other surface, the arms, projecting equally beyond the body, touch and engage the floor and serve as a supporting guard or stand as an integral part of the instrument 10.

As illustrated in FIGS. 1–4, both the lower side or lateral arm 5 and the upper lateral arm 4 are selectively extensible at at least one end by a selectively movable telescoping extensible end member or portion 2 that is variably adjustable in the direction of the peghead end of each respective arm 4 and 5. Each extensible member 2, forming an integral portion of its respective arm slidably moves and telescopes within and relative to its arm to thereby vary the overall length of the arm. In this manner, the length of the arms 4 and 5 may be selectively adjusted by selectively extending or retracting the extensible end member 2 to the desired length. In practice, the telescoping adjustment is maintained by frictional engagement between the member 2 and its respective arm. However, it could be fixed at its adjusted lengthwise position by conventional locking means (not shown) including, for example, a locking set screw. The extent of the relative lengthwise adjustment of the member 2 with respect to its arm 4 or 5 is limited only by their initial lengths and the distance of movement permitted thereby. In FIG. 1 the member 2 of arm 5 is fully withdrawn into arm 5. However, the broken lines illustrate how it too may be selectively moved and extended beyond the end of its arm.

Each arm member 2 has a shoulder strap securing button 1 provided at the outward end thereof while the body 7 of the instrument 10 may have a similar securing button 6 at any convenient location on the body 7 or elsewhere on the instrument 10 to which a strap may be conveniently secured. In use, a conventional shoulder support strap 12 is attached at one end to the instrument 10 at the button 6 and at its other end to a button 1 of the topmost side arm 4 or 5. The attachment of one end of shoulder strap 12 to the extensible end 2 of the topmost arm 4, as in the drawings, positions the strap 12 free of interference with the player's fingering of the strings 9 and of adjustment of them at the pegs on the neck 8.

The frame 20 is substantially symmetrical about its length. Either arm 4 or 5 that is laterally spaced from the body 7 may be utilized as the top arm or the bottom arm depending upon how the instrument is held by the player. Each arm, extending lengthwise along its respective side of the body 7 and neck 8 of the musical instrument, functions as a guard to protect the same from damage by accidental bumping or the like in the same manner as do the lower projecting ends of the arms 4 and 5 of the frame when the instrument 10 is stood on end. Thus, the frame 20 performs a laudable protective function when it is assembled as part of any musical instrument as is illustrated generally by the numeral 10.

The frame 20 also functions to provide the user with the unique ability to vary the balance of the instrument 10 while it is being played and by enabling the player to selectively vary the center of gravity of the instrument while at the same time also varying the straight-line extent of the shoulder strap 12 during use.

For example, when the instrument 10 is in use the strap 12 is positioned over and supported about the neck of the player. When the strap 12 is connected to the end member 2 of the arm 4 and the member 2 is fully withdrawn into its arm 4 as shown in FIG. 6, the strap 12 hangs down in a narrow inverted U-shape. This configuration of the strap 12 centers and concentrates all of the weight of the instrument 10 on a very small or narrow point of the neck and off of the shoulders of the player. As a consequence, this narrow point of the neck must support all of the weight of the instrument and, therefore, quickly tires the player. When the arm 4 is elongated in its length by the movement and adjustment of its member 10 to extend outwardly therefrom, the strap 12 is similarly caused to elongate. The strap 12 is caused to change from its narrow U-shape to that shape more nearly approaching a straight line such as is illustrated in FIG. 5.

The adjustment of the arm 4 of the frame 20 thereby automatically varies the support relationship that the strap 12 makes with the neck of the player and as a consequence elongates or enlarges the area along the neck and shoulders of the player from a concentrated point to a larger supportive area. The shifting of the dead weight of the instrument 10 on the player from the narrow concentration on the spine of the neck to the larger shoulder and overall back supportive area of the player is capable of being selectively controlled and manipulated simply by selectively moving and adjusting the extension of the arm 4 to which the strap 12 is attached. Moreover, all of this enhancement of the support is accomplished without the need to interrupt the "play" of the instrument.

Figure 5:
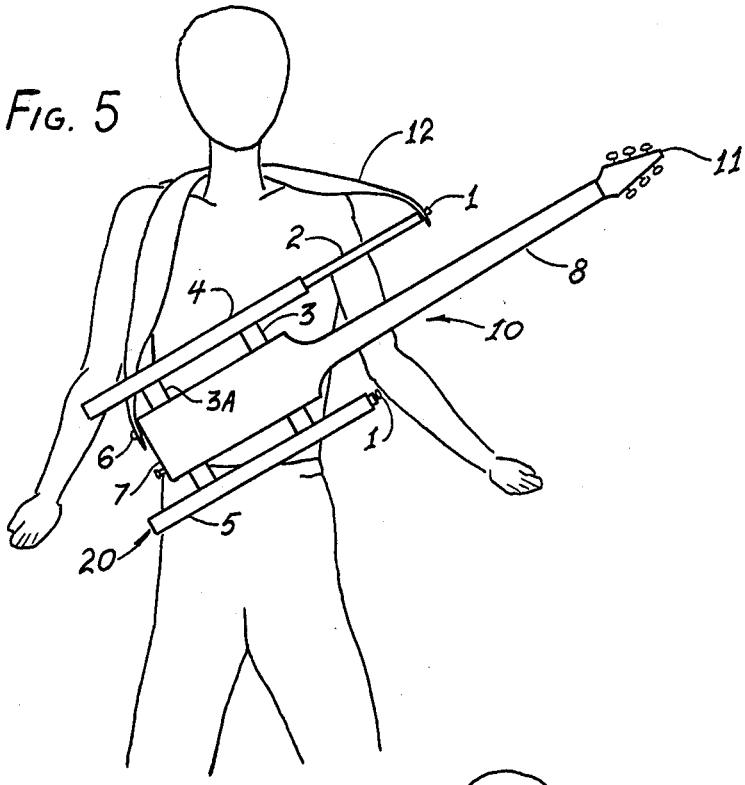
FIG. 5 illustrates the manner in which the instrument of FIG. 1 is played with an extensible arm of the frame support in an extended position.
Figure 6:
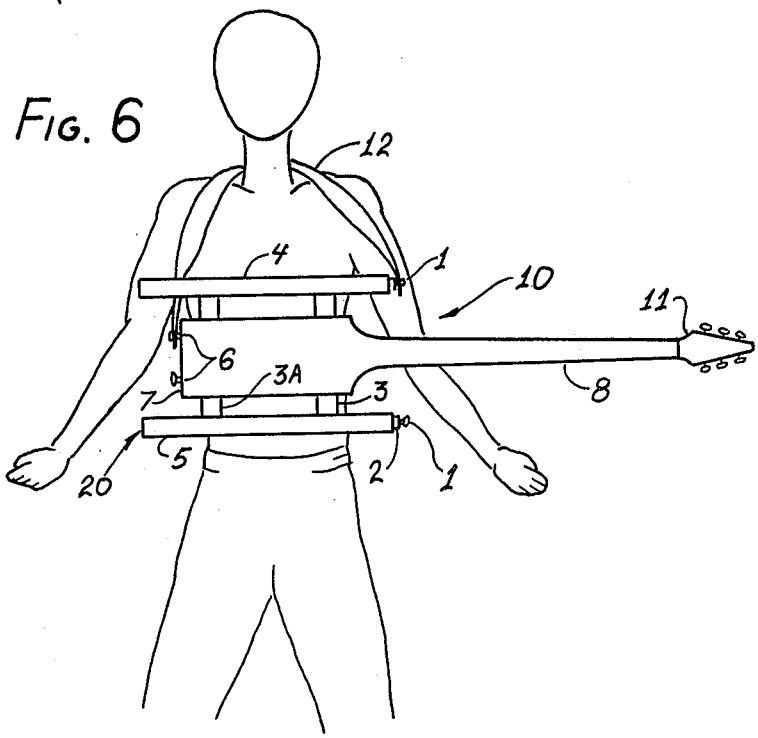
FIG. 6 illustrates the manner in which the instrument of FIG. 1 is played with the extensible arm in a retracted position.

By the same token, the selective adjustment of the lengthwise extent of the arm 4, to which the strap 12 is shown attached in FIGS. 5 and 6, produces a corresponding change in the balance and "feel" of the instrument 10. As the arm 4 is selectively varied in its length by the selected adjusted movement of the member 2 outwardly therefrom or inward thereinto, the concentrated center of gravity (mass) of the instrument is varied. As a result, there is a corresponding shift effected in the center of gravity of the whole of the instrument 10. This change or shift in the center of gravity of the instrument 10 causes the instrument to change in its balance.

Thus, if the member 2 of the arm 4 is moved outward, the center of mass or center of gravity of the instrument 10 is moved in like manner in the direction toward the peghead 11 of the instrument. This produces a corresponding shift in the balance of the weight of the instrument that changes the manner in which the instrument hangs or the manner in which it is worn by the player. By shifting the mass or weight of the instrument, especially in the area of the body 7, the weight distribution changes and the neck 8 and its peghead 11 with its attendant large mass of weight, will tend to pull or weigh down that corresponding end of the instrument 10. Because most stringed instruments as guitars balance with the peghead down or weigh so much that there is considerable fatigue when they are worn, it is important to be able to provide the player with the means to selectively vary the center of mass or center of gravity of the instrument and as a consequence, the balance and weight of the instrument from time to time during play.

The frame 20 of the present invention, being adaptable especially to musical stringed instruments, enables the user to protect the instrument by providing the side arms 4 and 5 laterally spaced along the body of the instrument to guard the instrument from accidental damage while also permitting the instrument to stand on its end without supporting the instrument on the sound producing portions of the instrument. In addition, the frame provides a novel structure as well as an attractive design for a stringed musical instrument to permit the supporting strap to be varied in its shape to enable the instrument to be more readily supported over larger areas of the player's shoulders and back when this is desired. The frame also enables the player to vary the location of the mass or center of gravity of the instrument during and without interruption of play of the same to thereby vary the balance of the instrument so as to make the same more comfortable and to reduce the tiring characteristics that most stringed musical instruments impart on the player.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A stringed musical instrument comprising a body, a string support neck extending outward from said body, a support frame for said body, said frame including at least an arm extensible on said frame to vary the length thereof and the center of gravity of said frame, and a shoulder support strap attached at one end to said instrument and at its other end to said extensible arm so that when said arm is selectively varied in its extension on said frame the same changes the location of the center of mass of said frame and the balance of said musical instrument.

2. A stringed musical instrument as in claim 1, said body having forward and rear portions and opposite sides, said frame extending beyond said rear portion for engagement with a surface at which the rear portion of said body may be supported free of touching engagement with the surface.

3. A stringed musical instrument as in claim 2, said frame including an arm spaced from and fixed along each of said opposite sides of said body to protect said respective side of said body.

4. A stringed musical instrument as in claim 3, an extensible member being extensible relative to each of said fixed arms to vary the length thereof and the balance of said musical instrument.

5. A stringed instrument having a body, a frame to which said body is attached, said frame having an arm, a supporting strap attached between its ends to support the stringed instrument about the neck of the player with one end of said strap being attached to said arm, and said arm being adjustable to vary its length such that the separation between the attachment of said supporting strap between the stringed instrument is varied corresponding to the varied lengthwise adjustment of said arm to thereby vary the support of said strap about the neck of the player.

6. A stringed instrument as in claim 5, said frame having two relatively spaced arms on opposite sides of said body when said frame is attached to said body.

7. A stringed instrument as in claim 6, each of said arms being adjustable in length such that said supporting strap may be attached to either one of said arms for adjustment thereby.

8. In a stringed instrument that has a frame, a body and string supporting neck, said frame comprising, a pair of side arms in spaced substantially parallel relationship, bracket means connecting said side arms in their spaced relationship and include means for connecting said frame with the body of the stringed instrument such that said side arms extend along the lengths and on opposite sides of the body and neck and spaced laterally therefrom, at least one of said side arms having means selectively movable relative to said frame and the body and the neck connected therewith to selectively vary the center of gravity of the frame such that when said frame is used as a part of the stringed instrument the center of gravity thereof and the balance of the stringed instrument may be selectively varied.

9. A frame as in claim 8, said selectively movable means being an arm connected with said side arm and being adjustable along said side arm relative to the length of said frame.

10. A frame as in claim 9, each of said side arms having said selectively movable means.

* * * * *